US008276340B2

(12) United States Patent
Meilleur et al.

(10) Patent No.: US 8,276,340 B2
(45) Date of Patent: Oct. 2, 2012

(54) CONCRETE WALL FORMWORK MODULE

(75) Inventors: Serge Meilleur, Varennes (CA); André Grenon, Ste-Julie (CA)

(73) Assignee: Polycrete International Inc., Montreal (CA)

( * ) Notice: Subject to any disclaimer, the term of this patent is extended or adjusted under 35 U.S.C. 154(b) by 759 days.

(21) Appl. No.: 11/883,800

(22) PCT Filed: Feb. 6, 2006

(86) PCT No.: PCT/CA2006/000170
§ 371 (c)(1),
(2), (4) Date: Aug. 7, 2007

(87) PCT Pub. No.: WO2006/081689
PCT Pub. Date: Aug. 10, 2006

(65) Prior Publication Data

US 2008/0005991 A1 Jan. 10, 2008

(30) Foreign Application Priority Data

Feb. 7, 2005 (CA) ..... 2496704

(51) Int. Cl.
*E04B 2/48* (2006.01)
*E04B 2/54* (2006.01)

(52) U.S. Cl. ..... 52/426; 52/427; 52/424; 52/425; 52/419

(58) Field of Classification Search ..... 52/426, 52/427, 429, 431, 439, 419, 415, 422, 424, 52/425
See application file for complete search history.

(56) References Cited

U.S. PATENT DOCUMENTS 838,844 A 12/1906 Clayton
1,102,991 A * 7/1914 McKennee ..... 52/428
1,650,485 A * 11/1927 Blank ..... 52/274
(Continued)

FOREIGN PATENT DOCUMENTS

CA 1233042 7/1917
(Continued)

OTHER PUBLICATIONS

International Search Report for PCT/CA2006/000170 dated May 1, 2006.

(Continued)

*Primary Examiner* — Phi Dieu Tran A
(74) *Attorney, Agent, or Firm* — Harrington & Smith

(57) ABSTRACT

A concrete wall formwork module comprising a first side wall panel structure including a first grid and a first panel secured to the first grid, a second side wall panel structure including a second grid and a second panel secured to the second grid, and connecting rods having about a same length hingedly interconnecting the first and second side wall panel structures to allow movement thereof between a retracted parallel relationship to a spaced apart parallel relationship. A plurality of such concrete wall formwork modules allow assembling a formwork which is functionally similar to conventional formwork since the facing side wall panel structures are connected in a parallel relationship by the thin spacer connecting rods which allow concrete to freely travel within the formwork. When the first and second side wall panel structures are in the retracted parallel relationship, the concrete wall formwork module is more compact and therefore easier and less costly to transport.

23 Claims, 16 Drawing Sheets

U.S. PATENT DOCUMENTS

| | | | | | |
|---|---|---|---|---|---|
| 1,911,626 | A | | 5/1933 | Larzelere | |
| 2,940,296 | A | * | 6/1960 | Gaspar | 52/565 |
| 3,025,650 | A | * | 3/1962 | Nelsson | 52/357 |
| 3,197,171 | A | * | 7/1965 | Michalak | 249/40 |
| 3,238,684 | A | * | 3/1966 | Wood | 52/379 |
| 3,321,884 | A | * | 5/1967 | Klaue | 52/565 |
| 3,327,986 | A | * | 6/1967 | Oury | 249/45 |
| 3,559,355 | A | | 2/1971 | Day, Jr. | 52/251 |
| 3,687,411 | A | * | 8/1972 | Frazier | 249/44 |
| 4,133,156 | A | * | 1/1979 | Unger | 52/383 |
| 4,234,156 | A | * | 11/1980 | Wepf | 249/40 |
| 4,320,888 | A | * | 3/1982 | Oury | 249/45 |
| 4,530,191 | A | * | 7/1985 | Boisbluche | 52/309.7 |
| 4,702,053 | A | * | 10/1987 | Hibbard | 52/309.7 |
| 4,888,931 | A | | 12/1989 | Meilleur | |
| 4,901,494 | A | * | 2/1990 | Miller et al. | 52/309.12 |
| 5,431,368 | A | * | 7/1995 | Wilde | 249/213 |
| 5,459,970 | A | * | 10/1995 | Kim | 52/424 |
| 5,611,183 | A | * | 3/1997 | Kim | 52/426 |
| 5,658,483 | A | * | 8/1997 | Boeshart | 249/191 |
| 5,782,050 | A | * | 7/1998 | Boeshart | 52/426 |
| 6,070,380 | A | | 6/2000 | Meilleur | |
| 6,178,711 | B1 | * | 1/2001 | Laird et al. | 52/427 |
| 6,691,486 | B1 | * | 2/2004 | Durand | 52/645 |
| 7,415,804 | B2 | * | 8/2008 | Coombs et al. | 52/426 |
| 2004/0040240 | A1 | | 3/2004 | Patz et al. | 52/309.11 |

FOREIGN PATENT DOCUMENTS

| | | | |
|---|---|---|---|
| CA | 1304952 | | 5/1919 |
| CA | 1328746 | | 4/1994 |
| CA | 2258985 | A1 | 7/2000 |
| EP | 1 662 062 | A2 | 3/2006 |
| FR | 2 252 461 | A1 | 6/1975 |
| GB | A 184050 | | 8/1922 |
| NL | 8501343 | A | 12/1986 |
| WO | WO 01/92656 | A1 | 12/2001 |
| WO | WO 02/22982 | A1 | 3/2002 |

OTHER PUBLICATIONS

Written Opinion of the International Searching Authority dated May 1, 2006.

Written Opinion of the International Preliminary Examining Authority dated Dec. 27, 2006.

Extended European Search Report for Application No. 06705126.8, Patent No. 1846625 PCT/CA2006000170, Dated Jul. 1, 2010.

* cited by examiner

CONCRETE WALL FORMWORK MODULE

FIELD OF THE INVENTION

The present invention relates to concrete forms. More specifically, the present invention is concerned with concrete wall formwork modules that can be assemble like bricks to form a mold into which concrete is poured. Once assembled and filled with concrete, the modules are left in place thereby providing a concrete wall with panels on both of its sides.

BACKGROUND OF THE INVENTION

A formwork for casting a concrete wall is traditionally assembled on the premises using two wood or metal panels maintained in spaced parallel relationship by tie-wires and other appropriate connection means at their ends. This formwork is expensive since its mounting and dismounting are time consuming.

U.S. Pat. No. 4,888,931 issued to Serge Meilleur on Dec. 26, 1989 and entitled "Insulating Formwork for Casting a Concrete Wall" discloses an insulating formwork for casting a concrete wall, which is made of foam panels connectable to each other in parallel relationship by means of tie-rods. Once assembled, the panels define a concrete formwork into which concrete can be poured.

Even though the assembly of this formwork is simplified by the configuration of the panels, the formwork must still be completely assembled on the premises, thereby requiring time and manual dexterity.

U.S. Pat. No. 6,070,380 also issued to Meilleur on Jun. 6, 2000 and entitled "Concrete Wall Formwork Module" discloses a prefabricated concrete formwork module that may be assembled with others similar modules in the manner of a brick wall to form a mould into which concrete is poured. Even though Meilleur's module solves the above-mentioned problem of the assembly, it presents the new drawback that it is cumbersome, takes a lot of space and is therefore costly to transport.

OBJECTS OF THE INVENTION

An object of the present invention is therefore to provide a concrete wall formwork module free of the above-mentioned drawbacks.

SUMMARY OF THE INVENTION

More specifically, in accordance with a first aspect of the present invention, there is provided a concrete wall formwork reinforcing mesh structure comprising:

a first side wall grid;

a second side wall grid; and at least two connecting rods having about a same length hingedly interconnecting the first and second side wall grids to allow movement thereof between a retracted parallel relationship to a spaced apart parallel relationship.

According to a second aspect of the present invention, there is provided a concrete wall formwork module comprising:

a first side wall panel structure including a first grid and a first panel mounted to the first grid;

a second side wall panel structure including a second grid and a second panel mounted to the second grid; and at least two connecting rods having about a same length hingedly interconnecting the first and second side wall panel structures to allow movement thereof between a retracted parallel relationship to a spaced apart parallel relationship.

When the first and second side wall panel structures are in the retracted parallel relationship, the concrete wall formwork module is more compact and therefore easier and less costly to transport.

According to a third aspect of the present invention, there is provided a concrete wall formwork corner element for interconnecting two pairs of formwork side walls, each pair positioned in a spaced apart parallel relationship, the corner element comprising:

a reinforcing mesh defining two grid walls defining an angle therebetween; each grid wall having a side edge and a fastening plate secured to the side edge; and two panel elements, each secured to a respective grid walls;

whereby, in operation, the corner element is positioned between the two pairs of formwork side walls so that each of the two panel elements contacts a side edge of a side wall from a respective pair of the two pairs of formwork side walls while the fastening plate overlays the side wall from a respective pair of the two pairs of formwork side walls.

According to a fourth aspect of the present invention, there is provided a method for creating a corner assembly for a formwork comprising:

providing a corner element according to the third aspect of the present invention;

providing first and second modules according to the second aspect of the present invention;

positioning each the first and second modules in the spaced apart relationship;

abutting both the first and second modules to the corner element so that the first side wall panels of both the first and second modules are positioned adjacent one another, the second wall panel of the first module contacts a first one of the fastening plates of the corner element and the second wall panel of the second module contacts a second one of the fastening plates of the corner element;

fastening the second wall panel of the first module to the first one of the fastening plates of the corner element and the second wall panel of the second module to the second one of the fastening plates of the corner element;

securing the first wall panel of the first module to the first wall panel of the second module using an iron angle; and securing the iron angle to the corner element.

The concrete wall formwork module according to the present invention allows resisting to sideways thrusting which occurs during the pour of the concrete therein and to the use of a vibrator to stiffen the concrete. It allows assembling formworks which are functionally similar to conventional formworks since the facing side wall panel structures of the module are connected in a parallel relationship by thin spacer connecting rods which allow concrete to freely travel within the formwork.

Other objects, advantages and features of the present invention will become more apparent upon reading the following non restrictive description of illustrated embodiments thereof, given by way of example only with reference to the accompanying drawings.

DETAILED DESCRIPTION

Figure 1:
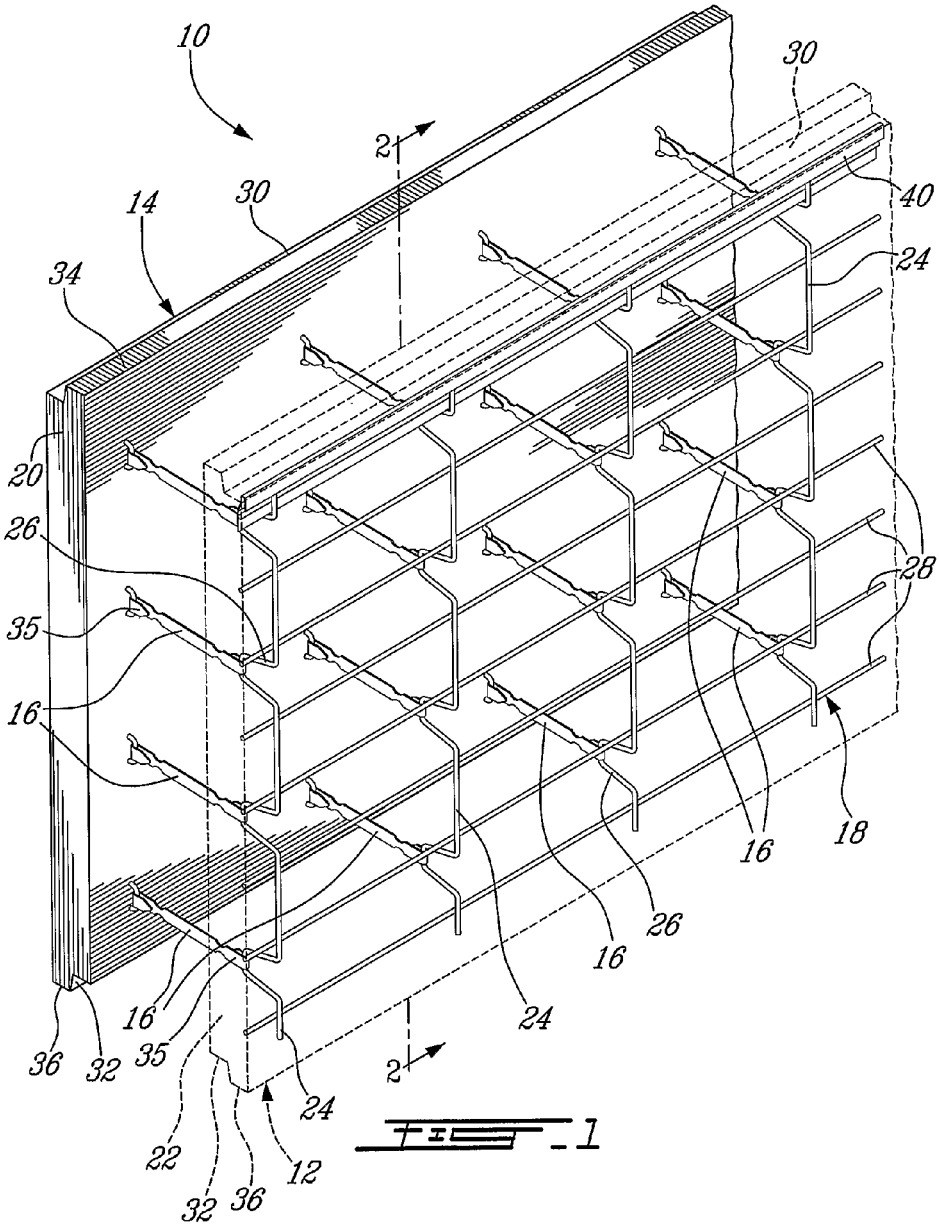
FIG. 1 is a perspective view of a concrete wall formwork module according to a first illustrative embodiment of the present invention.
Figure 2:
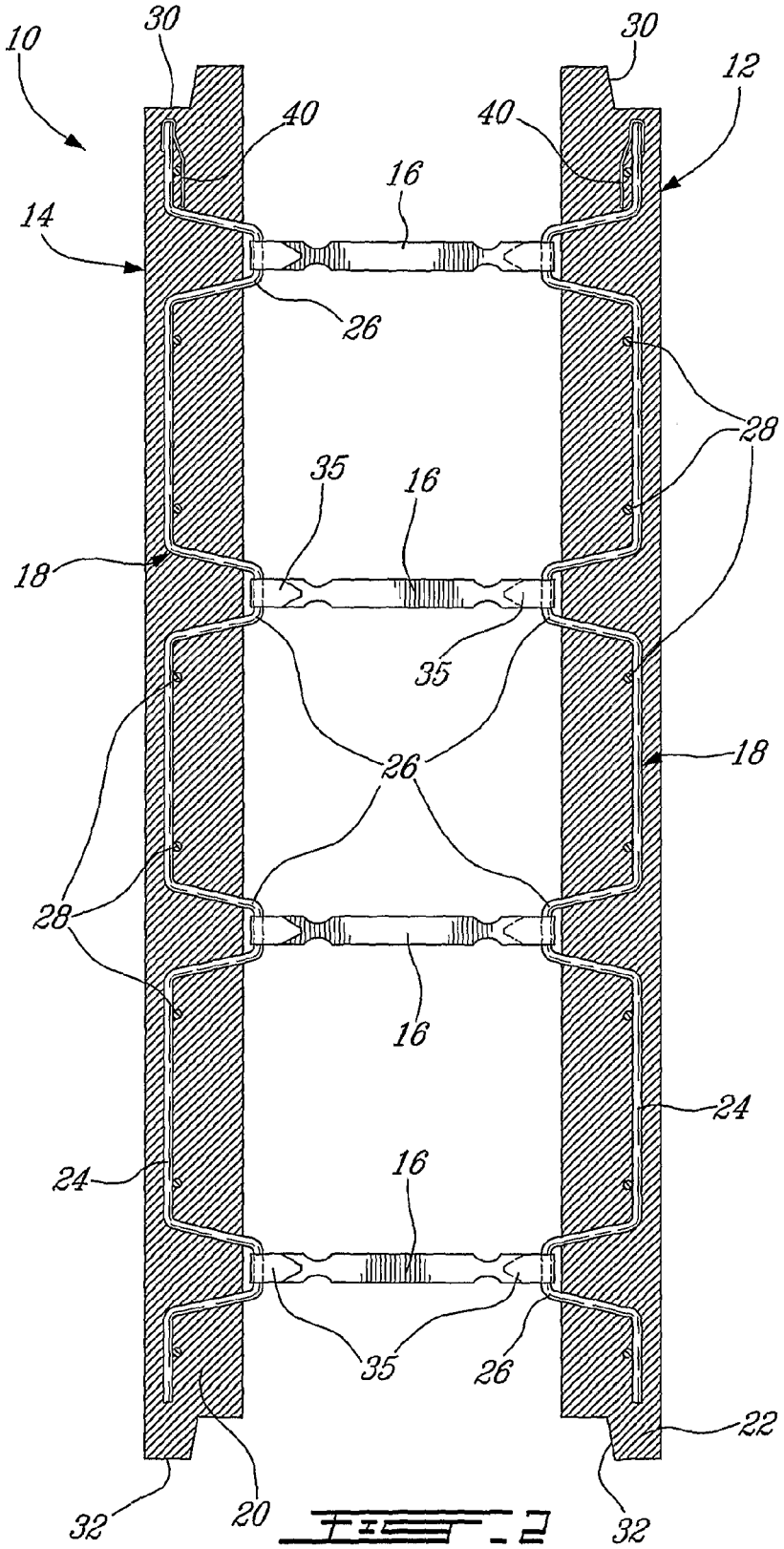
FIG. 2 is a side elevation taken along line 2-2 from FIG. 1.

A concrete wall formwork module 10 according to a first illustrative embodiment of the present invention will now be described with reference to FIGS. 1 and 2 of the appended drawings.

The concrete wall formwork module 10 comprises first and second side wall panel structures 12 and 14 and a plurality of connecting spacer rods 16 for hingedly interconnecting the first and second side wall panel structures 12 and 14.

Each side wall panel structures 12 and 14 includes a rectangular metallic side wall wire grid 18 embedded in a respective insulated foam panel 20, 22. The two side wall grids 18 together with the plurality of spacer rods 16 define a deployable concrete wall formwork reinforcing mesh structure.

Each wire grid 18 includes a series of parallel vertical metallic rods 24 generally extending along the height of its respective panel 12 or 14. The rods 24 are configured so as to define stand-out portions yielding lugs 26 as will be described furtherin in more detail. The vertical rods 24 allow providing structural integrity to the module 10 when concrete is poured therein.

Each grid 18 further includes parallel horizontal metallic rods 28 extending along the width of the respective panel 12 or 14. The horizontal rods 28 are secured to the vertical rods 24 through welding. More specifically, the horizontal rods 28 are positioned on the interior side of the vertical rods 24 so as to protect the welding joints from the sideways thrust which occurs during the pour of the concrete between the two side wall panel structures 12 and 14 as will be explained hereinbelow in more detail.

The top and bottom edge portions 30 and 32 of each panel 12 or 14 are configured for complementary engagement. More specifically, the top and bottom edge portions 30 and 32 are provided with grooves 34 and 36 positioned on opposite sides in a complementary way. Other engagement means, including tongues and grooves can alternatively be provided on the top and bottom edge portions 30 and 32.

When the top and bottom edge portions 30 and 32 of the panels 12-14 are flat, fastening means can be used to assemble modules 10 on top of each other.

The panels 12 and 14 are made of low density plastic foam having a high insulating ability such as polyurethane and expanded or extruded polystyrene. Other materials can also be used. Moreover, as will be explained and illustrated hereinbelow, the two panels 12 and 14 need not to be made from the same material.

Each panel 12 or 14 is rectangular in shape and extends along a given height (h) and a given length (l).

The thickness of each panel 12 and 14 may vary depending on the applications, its material, its insulating ability, the strength of the material, the surface of the panel, etc.

Each panel 12 or 14 is molded with the grid 18 so positioned therein that the stand-out portions 26 extend therefrom for receiving the connecting rods 16 as will now be explained. More specifically, the stand-out portions 26 extend from their respective panel 20 and 22 from a distance sufficient to allow the rods 16 to freely pivot thereabout. The extending length is however kept to a minimum so as to provide stiffness to the module 10.

The connecting spacer rods 16 are in the form of elongated metal plates having bended longitudinal ends defining hook portions 35 for receiving the stand-out portions 26 of the grid 18. The metal plates 16 are so bended as to yield the hooks 35 on opposite sides thereof, resulting in a more secured attachment between the two panels 12-14.

Figure 3:
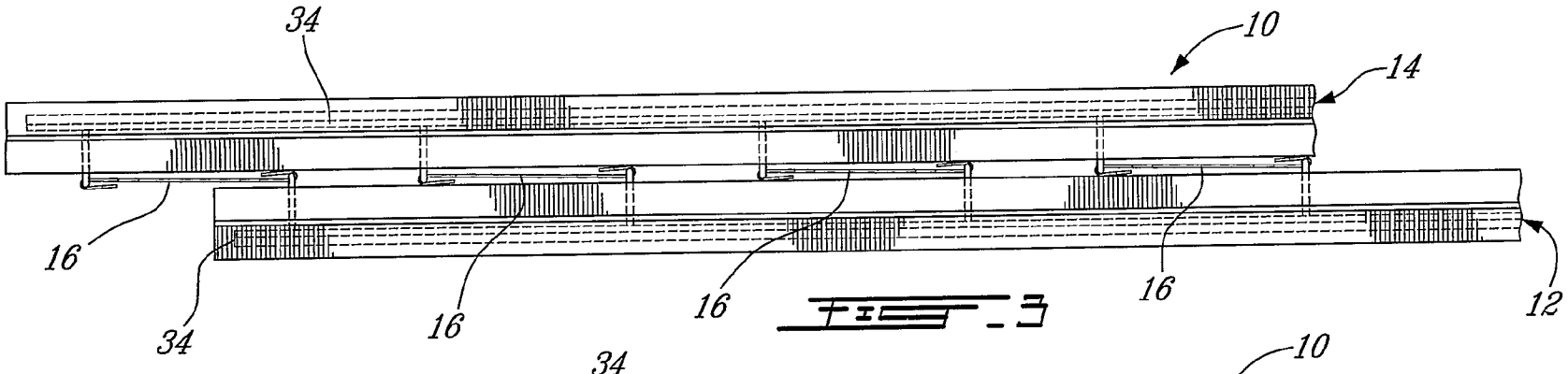
FIG. 3 is a top plan view of the module from FIG. 1, illustrating the first and second side wall panel structures of the module in a retracted parallel relationship.
Figure 4:
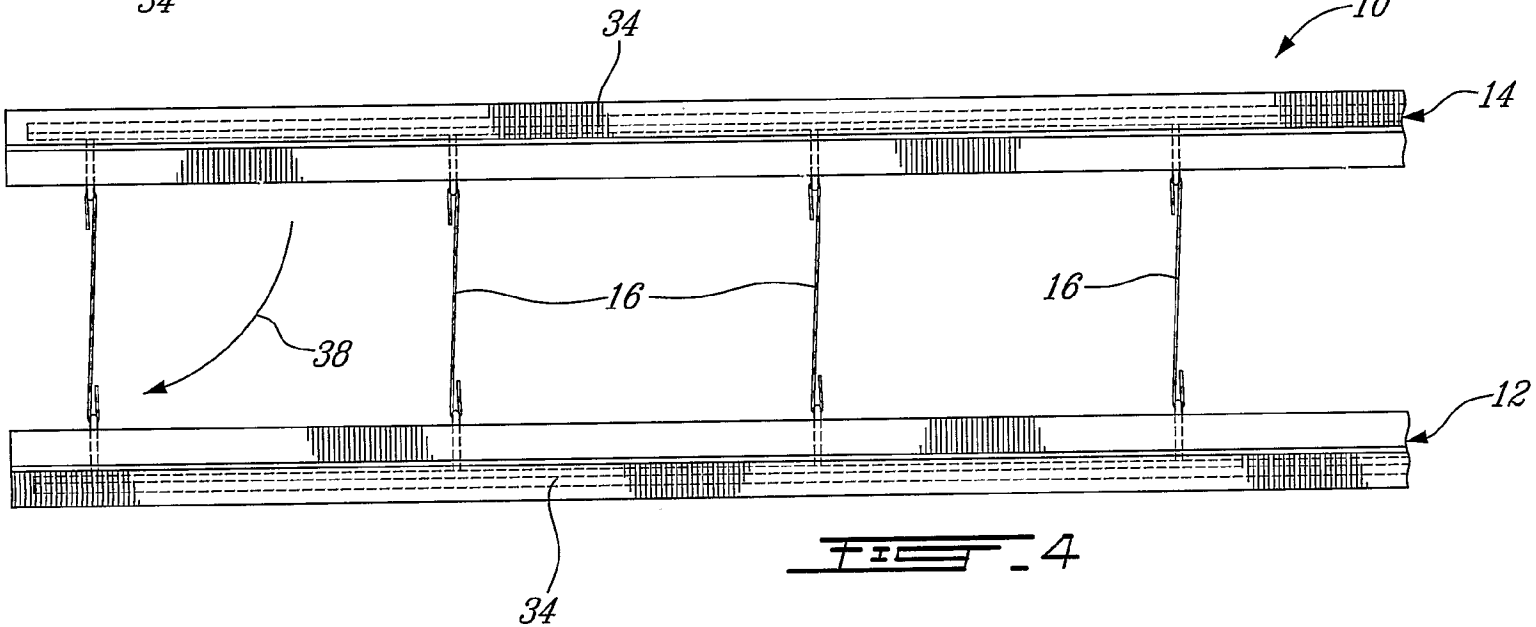
FIG. 4 is a top plan view of the module from FIG. 1, illustrated the first and second side wall panel structures of the module in a spaced apart parallel relationship.

As illustrated in FIGS. 3 and 4, the two side wall panel structures 12 and 14 are movable between a retracted parallel relationship (illustrated in FIG. 3) to a spaced apart parallel relationship (illustrated in FIG. 4) (see arrow 38).

While in the retracted parallel relationship, the module 10 is easily transportable and can be stored or transported without taking too much space.

The module 10 can be easily extended and assembled with other similar modules to provide a concrete wall formwork. The connecting rods 16 allow to readily position the two side walls defined by the side wall panel structures 12 and 14 at the predetermined distance. Therefore, no measuring is required on the premises to set the appropriate distance between the two walls 12 and 14. Of course, the module 10 can be modified and more specifically the connecting rods 16 can be sized for a specific formwork application.

Even though only two connecting rods 16 are sufficient to maintain the parallel relationship between the two side wall panel structures 12 and 14, a person skilled in art would appreciate that the use of a plurality of connecting spacer rods 16 disposed regularly throughout the surface of the module 10 further allows maintaining the integrity of the concrete wall formwork module 10 during the sideways thrust which occurs during pouring of the concrete between the two side wall panel structures 12 and 14.

Returning briefly to FIGS. 1 and 2, an elongated fastening plate 40 extends along the width of each side wall panel structures 12 and 14 parallel to the horizontal rods 28. The plate 40 includes a flange for securing the plate 40 on the top portion of the grid 18 in a snap fitted way. The fastening plate 40 can also be secured to the grid 18 using fasteners or other fastening means.

Even though the module 10 has been illustrated with a grid 18 having stand-out portions 26 on the vertical rods 24, a person skilled in the art will appreciate that the horizontal rods can alternatively be shaped to include stand-out portions.

The assembly of a plurality of modules 10 in a formwork and their use to receive concrete will now be explained in more detail with reference to FIGS. 5 to 8.

Figure 5:
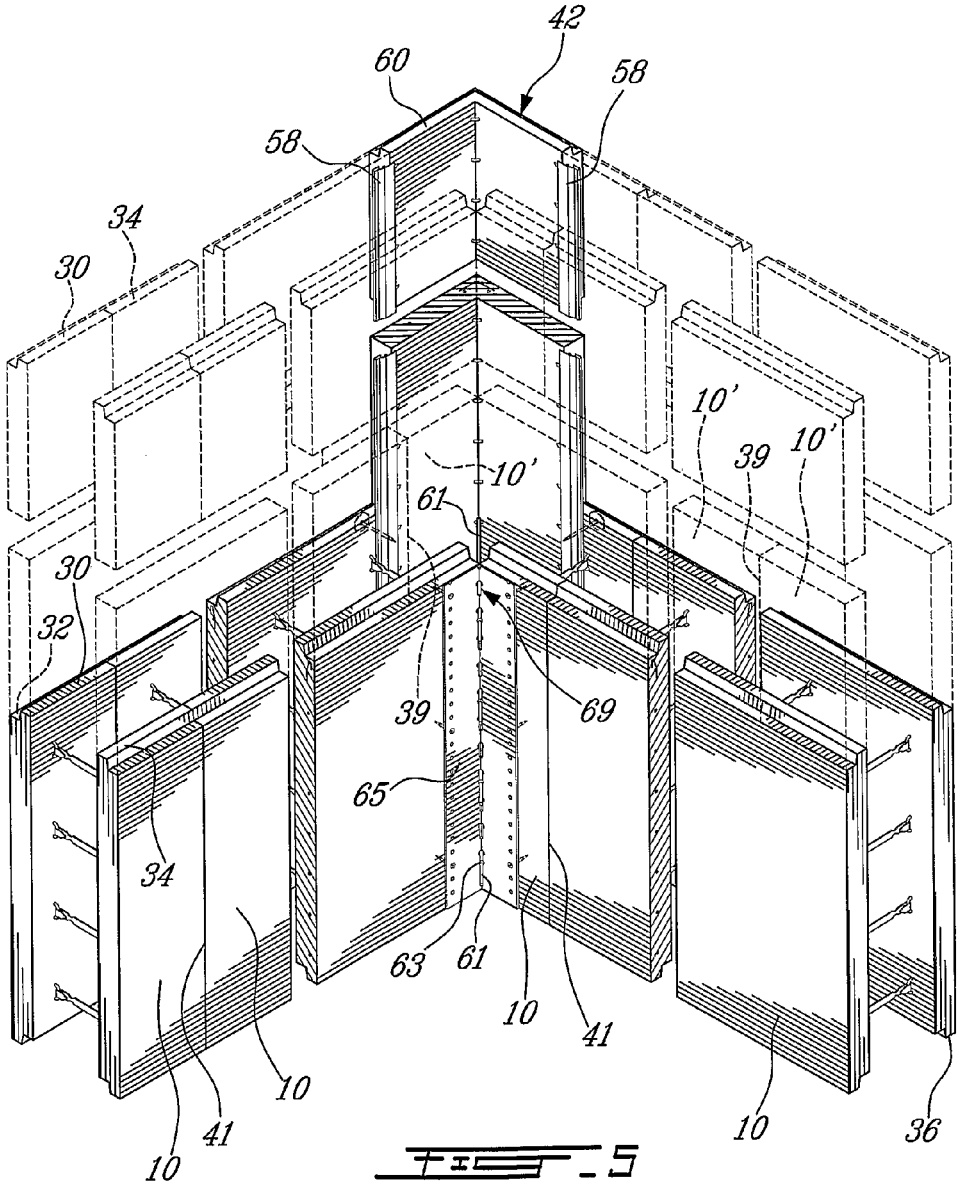
FIG. 5 is a perspective view of an assembly of a plurality of module from FIG. 1 in a formwork, the formwork being only partially illustrated, including a concrete wall formwork corner element according to a first illustrative embodiment of the present invention.

As illustrated in FIG. 5, two adjacent modules 10 on a same row are abutted. Then they are secured to one another by attaching adjacent pairs of stand-out portions 26, one from each module 10, using tie wires.

Two adjacent modules 10 and 10' on two different rows are connected through their top and bottom end edge portions 30 and 32. More specifically, as described hereinabove, the complementary grooves 34 and 36 are joined. Two adjacent modules 10 and 10' are also secured to one another by attaching adjacent pairs of stand-out portions 26, one from each module 10 and 10', using tie wires (not shown).

Of course, all the modules 10 and 10' are then fully extended and their first and second side wall panel structures 12 and 14 are in their spaced apart relationship. It is to be noted that the modules 10' are identical to the modules 10. A different numeral reference is used to enlighten the fact that they are located on the second row and thus are distinct modules.

The assembly of the concrete wall formwork module 10 and 10' in two parallel formwork walls is done similarly to the assembly of a brick wall: the modules 10' on the second row are so positioned that the lateral joints 39 between two adjacent modules are not aligned with similar lateral joints 41 between two adjacent modules from the first row. The same principle of course applies for any two consecutive rows. Of course, a person skilled in the art would appreciate that at least one concrete wall formwork module 10 or 10' from at least one out of two consecutive rows is of a different width than the others. This narrower module is either manufactured narrower or cut to the required width.

A concrete wall formwork corner element 42 according to a first illustrative embodiment of the present invention is provided at the intersection of two perpendicular rows to close the formwork and obviously restrain concrete 43 therein. The corner element 42 will now be described in more detail with references to FIGS. 5 to 8.

The corner element 42 includes an L-shaped grid 44 embedded in an L-shaped insulated foam panel 46. Similarly to the grid 18', the L-shaped grid 44 includes a series of vertical rods 48 and a series of horizontal rods 50 secured to the vertical rods 48. An L-shaped support corner 52 is secured to the external side of the corner of the grid 44. The horizontal rods 48 are so shaped as to define stand-out portions 54 at the intersection of the two walls defined by the L-shaped foam panel 46. The stand-out portions are so configured and sized so as to extend from the foam panel 46.

Each of the two lateral side arm portions of the L-shaped grid 44 ends with a protruding portion 56 which extends out of the foam panel 46 parallel thereto. Each of the two lateral edges of the grid 48, which are defined by the extremities of the protruding portions 56, receives an elongated fastening plate 58, similar in structure to the elongated fastening plate 40. The fastening plates 58 allow securing adjacent modules 10 or 10' thereto by providing a surface to receive fasteners 57. Washers 59 are further used to limit the penetration of the fastener 57 in the module 10 or 10' as it is well known. The fastening plates 58 are welded to the protruding portions 56 of the grid 48. Other securing method can of course be used.

The top and bottom edge portions 60 and 62 of the corner element 42 are also configured for complementary engagement. More specifically, the top and bottom edge portions 60 and 62 are provided with grooves 34 and 36 positioned on opposite sides in a complementary way and for complementary engagement with the top and bottom edge portions 30 and 32 of the module 10 and 10'.

The corner element 42 is further secured to each pair of adjacent intersecting modules 10 or 10' by the use of a series of parallel transversal corner rods 61. Each corner rod 61 has one of its longitudinal ends is mounted to a stand-out portion 54 of the L-shaped grid 44. The other longitudinal end of each corner rod 61 is secured to an angle iron 65 mounted to both adjacent modules 10 or 10' at the intersection thereof using fasteners 67 in the form of screws. Other fasteners can also be used.

The rods 61 are provided with widening ball portions 63 at predetermined position along its length. The corner portion of the angle iron 65 includes engagement slots 69 for receiving a ball portion 63 of the rod 61. Each engagement slot 69 includes an enlarged portion for allowing passage for the ball portions 63 and an elongated portion for receiving the narrower portion of the rod 61 as it is believed to be well known in the art.

The plurality of ball portions 63 on a single rod 61 make them adaptable for corner elements and corresponding modules having different geometries.

Of course, the number or gap between each corner rods 61 may vary.

The angle iron 65 can be removed when the formwork is complete.

Figure 6:
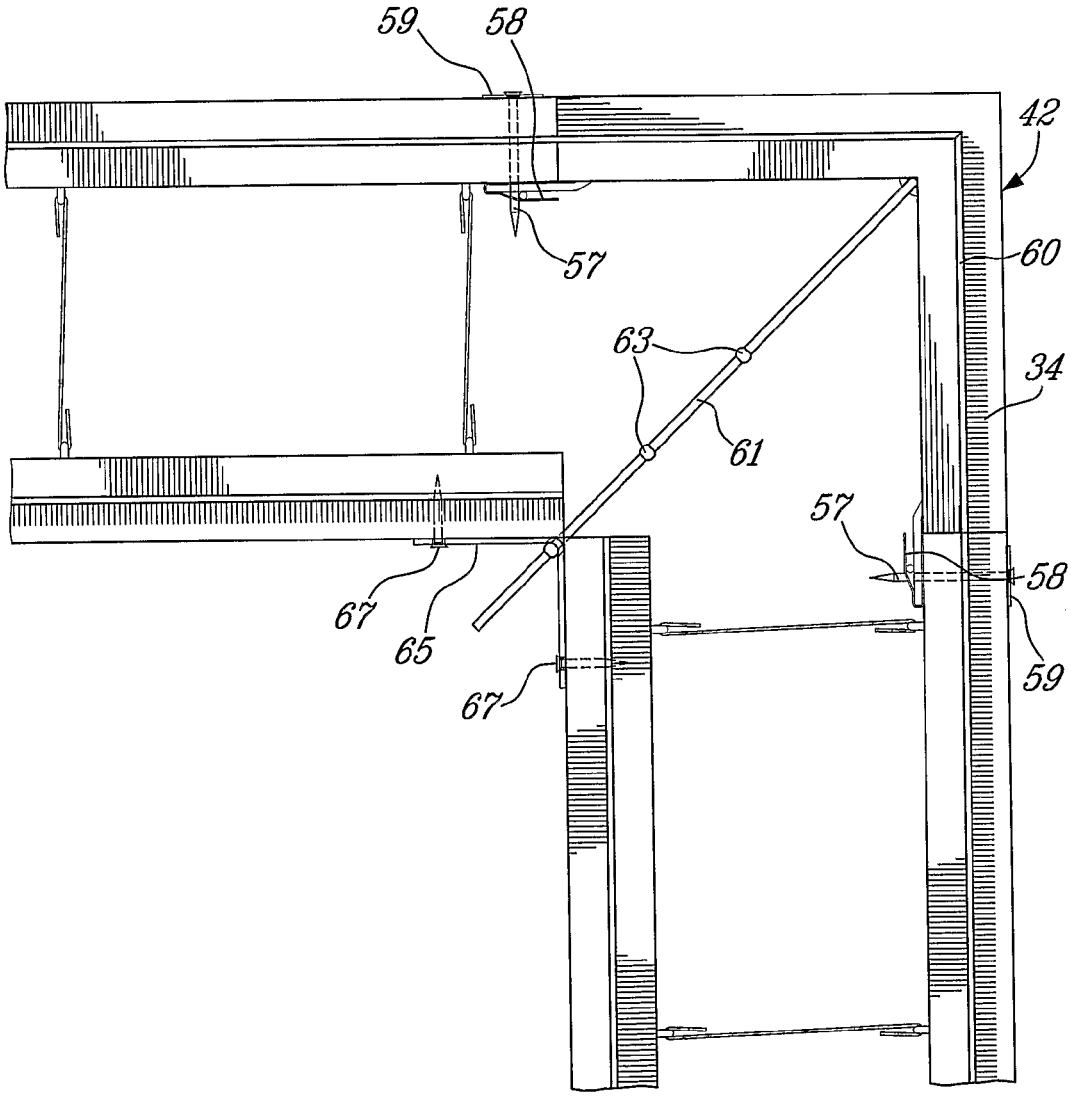
FIG. 6 is a partial top plan view of the assembly from FIG. 5, illustrating the assembly of the corner element with two adjacent modules from FIG. 1.
Figure 6A:
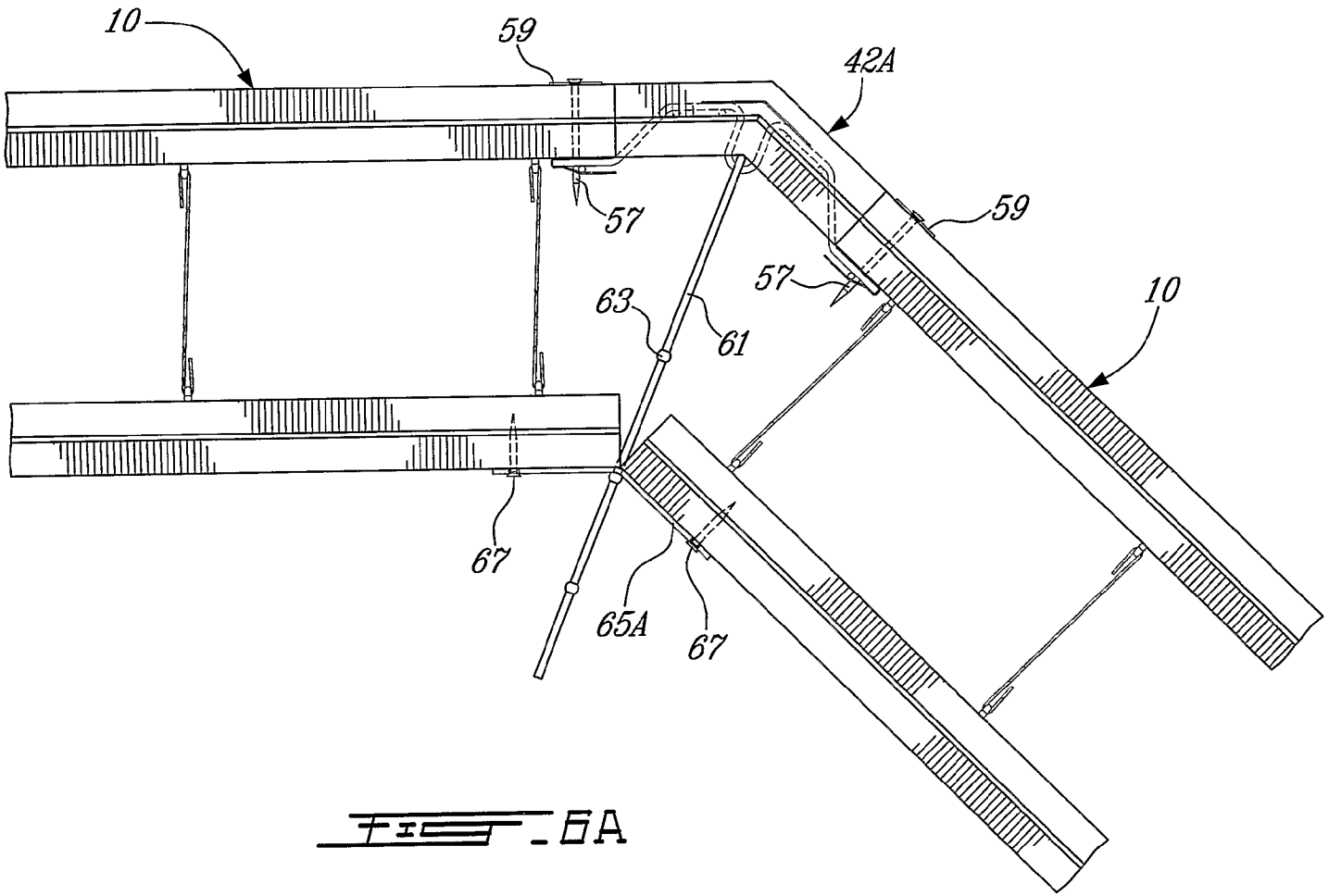
FIG. 6A is a partial top plan view of a concrete wall formwork corner element according to a second illustrative embodiment of the present invention.
Figure 7:
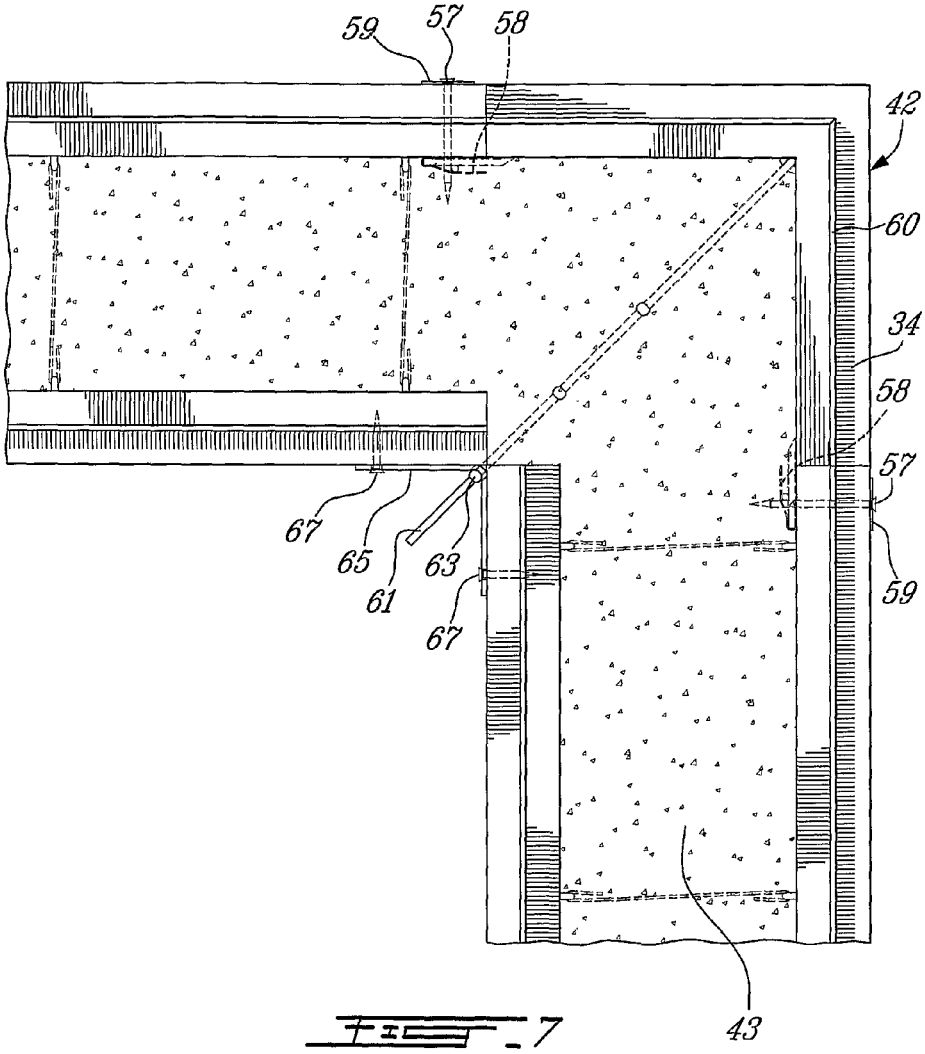
FIG. 7 is a top plan view similar to FIG. 6, illustrating the resulting formwork with concrete poured therein.
Figure 8:
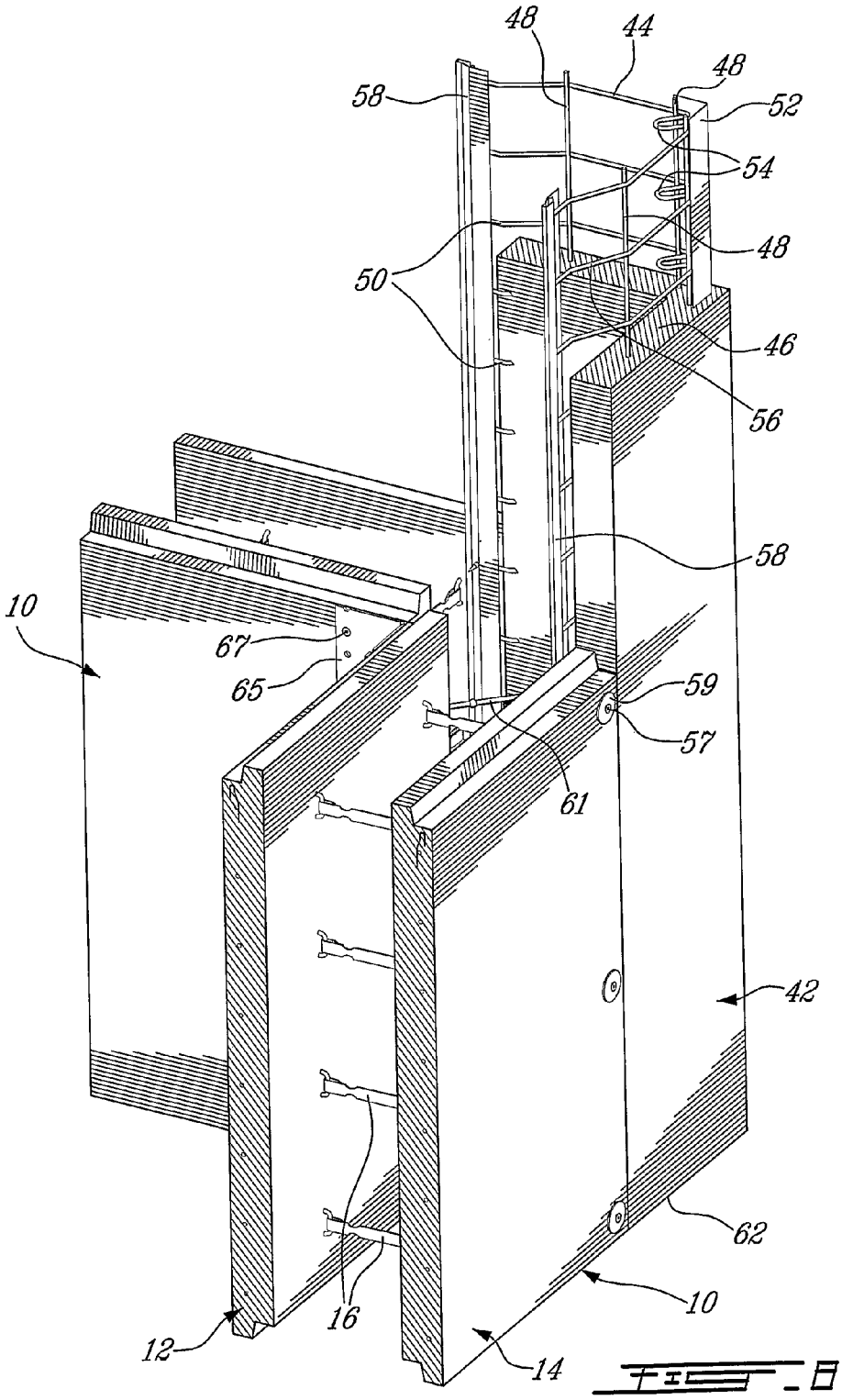
FIG. 8 is a perspective view of the assembly from FIG. 6.

As illustrated in FIG. 6A, a concrete wall formwork corner element 42A according to a second illustrative embodiment of the present invention is provided at the intersection of two rows defining a 135 degrees angle between them. Since the corner element 42A is very similar to the corner element 42, only the differences between these two corner elements will be described herein in more detail.

The corner element 42A, including its inner mesh and its foam panel is so shaped as to define a 135 angle. The iron angle 65 is replaced by a similar 135-degrees corner plate 65A.

Figure 9:
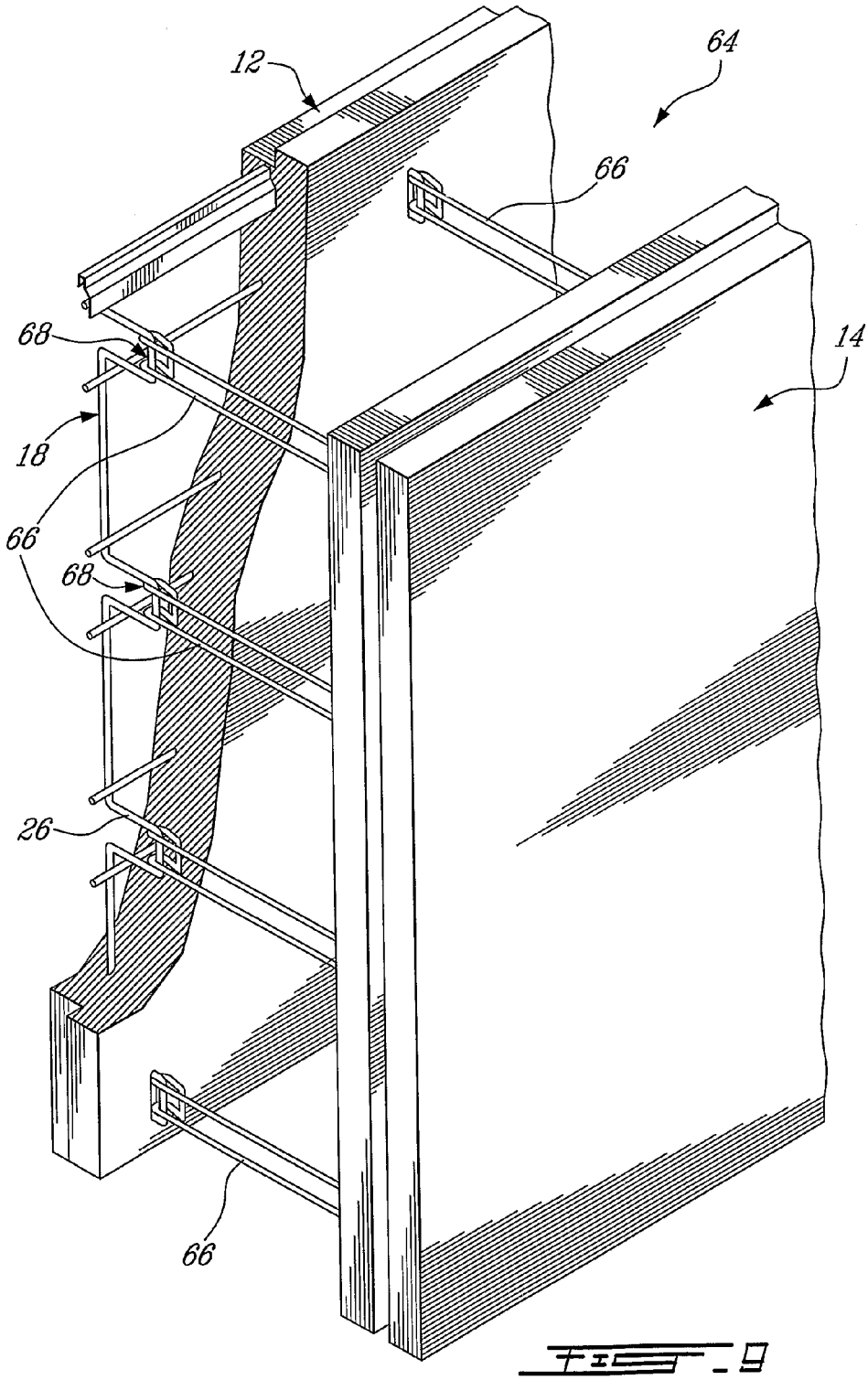
FIG. 9 is a perspective view of a concrete wall formwork module according to a second illustrative embodiment of the present invention.
Figure 10:
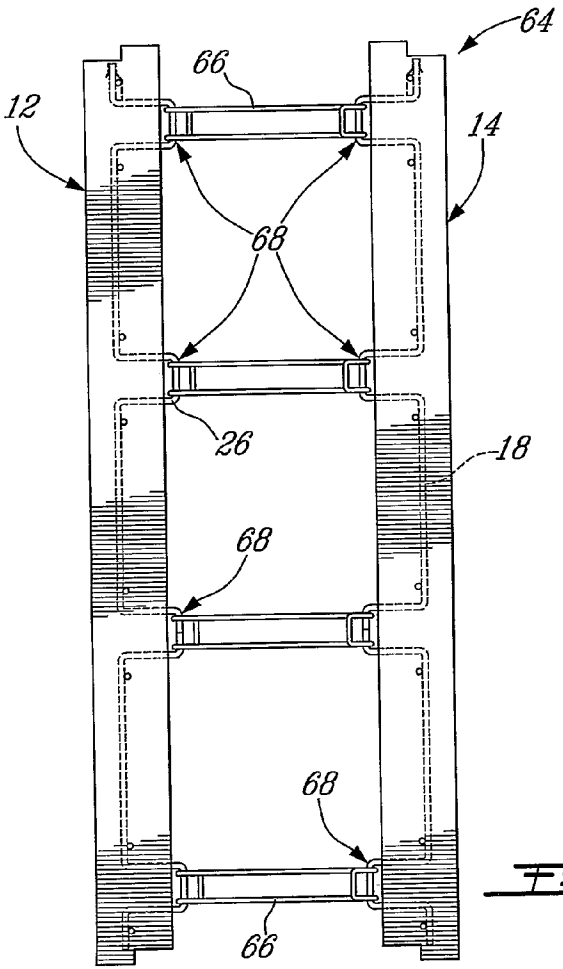
FIG. 10 is a side elevation of the module From FIG. 9.

A concrete wall formwork module 64 according to a second illustrative embodiment of the present invention will now be described with reference to FIGS. 9-10. Since the module 64 is very similar to the module 10, and for concision purposes, only the differences between the two modules 10 and 64 will be described herein in more detail.

The concrete wall formwork module 64 comprises first and second side wall panel structures 12 and 14 and a plurality of connecting spacer rods 66 for hingedly interconnecting the first and second side wall panel structures 12 and 14.

The connecting spacer rods 66 are in the form of elongated rectangular wire frames having their longitudinal ends folded up towards each other so as to define two hinges 68 with respective stand-out portions 26 of the grid 18.

Figure 11B:
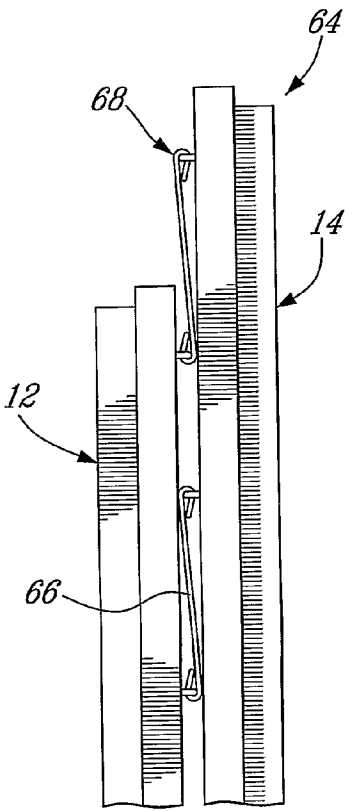
FIGS. 11A-11B are top plan partial views of the module from FIG. 9, illustrating the first and second side wall panel structures of the module respectively in a retracted parallel relationship and in a spaced apart parallel relationship.
Figure 11A:
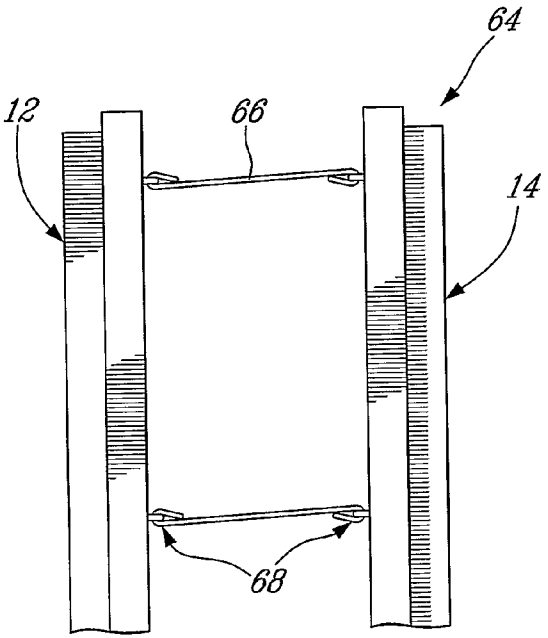

The connecting spacer rods 66 allow providing stability to the module 64 along the horizontal axis. Also, as illustrated in FIGS. 11A-11B, the two side wall panel structures 12 and 14 are made movable by hinges 68 between a retracted parallel relationship (illustrated in FIG. 11A) and a spaced apart parallel relationship (illustrated in FIG. 11B).

Figure 13:
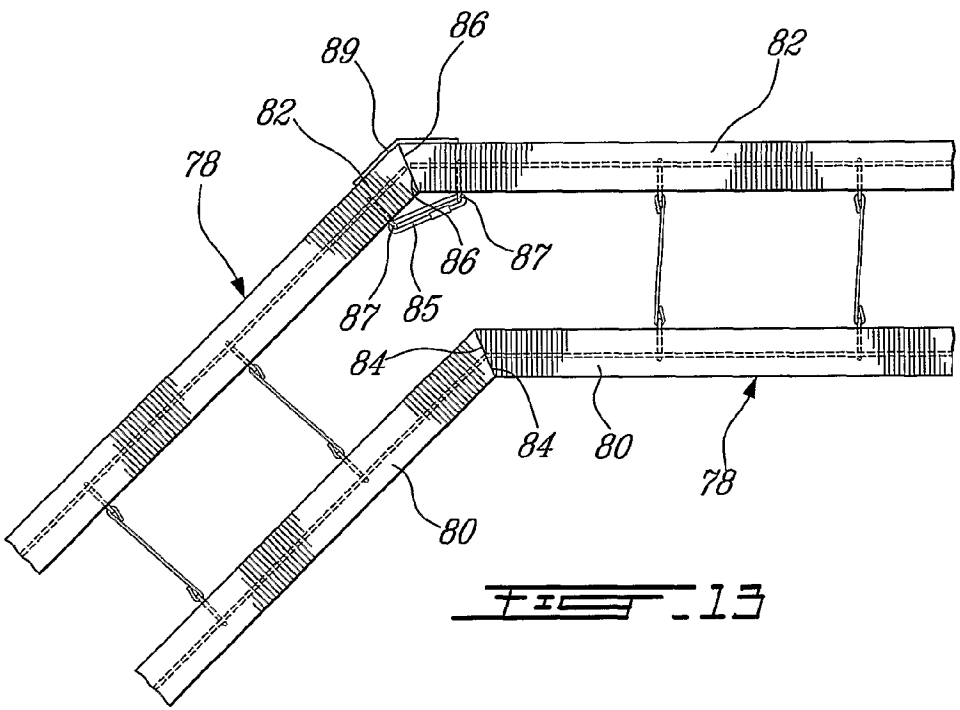
FIG. 13 is a top plan view illustrating a method for creating a 135 degrees corner between two intersecting modules similar to the module from FIG. 9.
Figure 12:
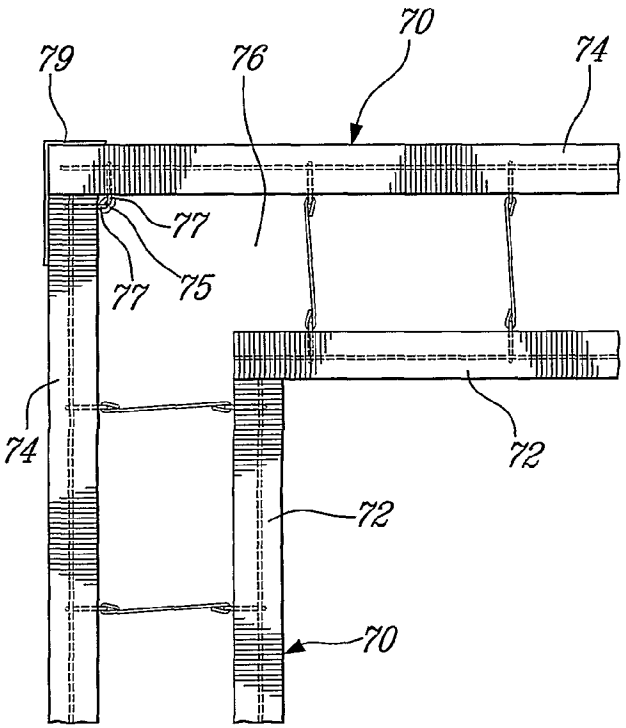
FIG. 12 is a top plan view illustrating a method for creating a 90 degrees corner between two intersecting modules similar to the module from FIG. 9.

FIGS. 12 and 13 illustrate two alternative methods to the corner element 42 to create closed junctions between two intersecting concrete wall formwork modules according to the present invention. Even though, the present method of assembly will be described with reference to the modules structurally identical to the module 64, it can also be used to assemble other concrete wall formwork modules from the present invention as will be described furtherin.

In FIG. 12, two modules 70 are joined perpendicularly forming a 90 degrees corner. The modules 70 are identical to the modules 64 with the exception that one of the two side wall panel structures 72 and 74 is shorter than the other. This allows perpendicularly abutting the two modules 70 and still yielding a continuous canal 76 for receiving concrete (not shown).

Connections between the two modules 70 and integrity of the corner assembly is provided 1) by attaching the facing pair of stand-outs 77 (each pair including a stand-out from each module 70) located near the actual intersection of the two modules 70 using tie wire 75, and 2) by securing an angle iron 79 at the intersection of the two modules 74 opposite the stand-outs 77 outside the channel 76.

FIG. 13 illustrates the assembly of two modules 78 into a 135 degrees corner. This assembly is achieved by providing modules 78 structurally similar to the modules 64 and 74 but having the following differences: 1) one of the two side panel structures 80 and 82 is shorter than the other, and 2) the two longitudinal ends 84 and 86 of both side panel structures 80 and 82 defines a 67.5 degrees with the plane defined by the panels 80 and 82. Thereby, abutting the two longitudinal ends 84 and 86 of a first module 78 with the respective longitudinal ends 84 and 86 of another module 78 results in a 135 degrees corner. Of course, a corner defining another angle can be achieved by providing side panel structures having longitudinal ends defining half that angle.

As described with reference to FIG. 12, connections between the two modules 78 and integrity of the resulting corner assembly is provided 1) by attaching the facing pairs of stand-outs 87 (each pair including a stand-out from each module 78) located near the actual intersection of the two modules 78 using a clip 85, and 2) by securing an elongated 135-degrees angled corner plate 89 at the intersection of the two modules 78 opposite the stand-outs outside the channel formed thereby.

Figure 14:
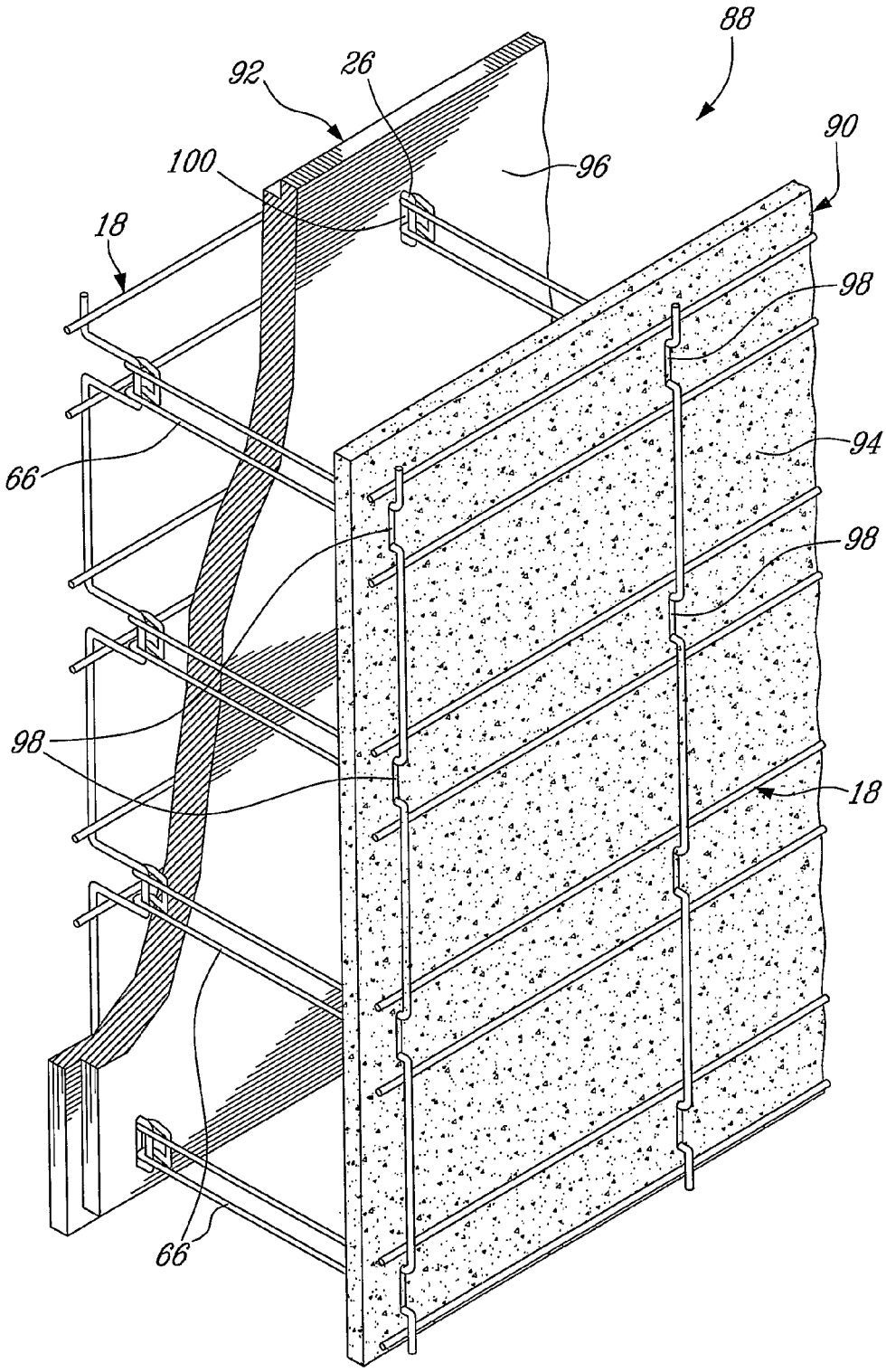
FIG. 14 is a perspective view of a concrete wall formwork module according to a third illustrative embodiment of the present invention.
Figure 15:
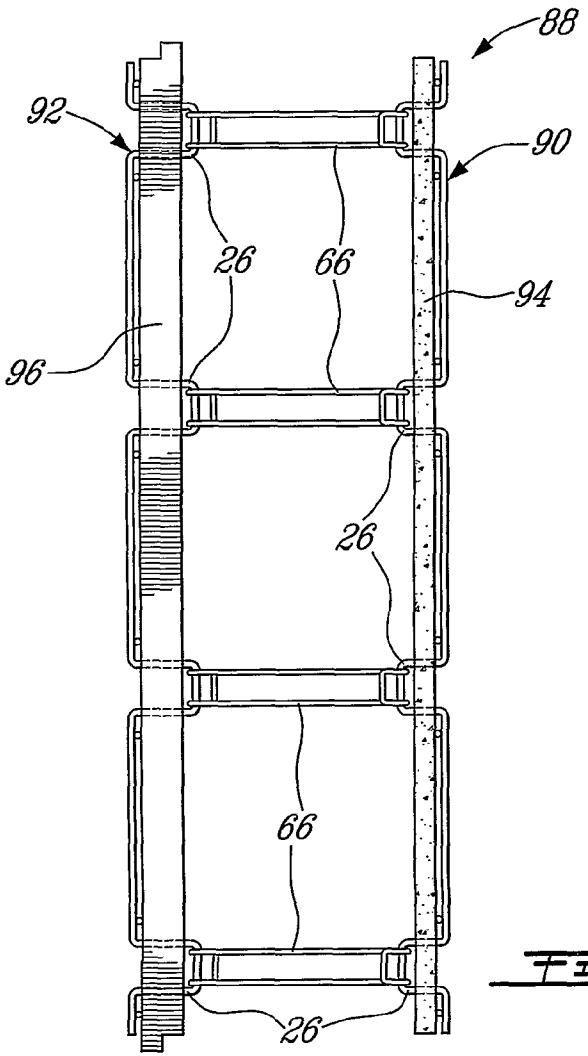
FIG. 15 is a side elevation of the module From FIG. 14.

FIGS. 14-16 illustrate a concrete wall formwork module 88 according to a third illustrative embodiment of the present invention. Since the module 88 is similar to the module 64, and for concision purposes, only the differences between the two modules 64 and 88 will be described herein in more detail.

The concrete wall formwork module 88 comprises first and second side wall panel structures 90 and 92 and a plurality of connecting spacer rods 66 for hingedly interconnecting the first and second side wall panel structures 90 and 92.

Each side wall panel structures 90 and 92 includes a metallic wire grid 18 and a respective panel 94 and 96 so mounted thereon that the grid 18 is positioned on the exterior side surface of the panel 94 or 96.

The panel 94 is a rigid panel of wood, made for example of presswood, laminated wood, or cement fiberboard, just to name a few.

The panel 96 is a low density plastic foam panel similar to the panels 20 and 22.

Both panels 94 and 96 include respective slots 98 and 100 for receiving the stand-out portions 26 of the grids 18. The panels 94 and 96 are secured to their respective grid 18 by positioning the spacer rods 66.

Figure 16B:
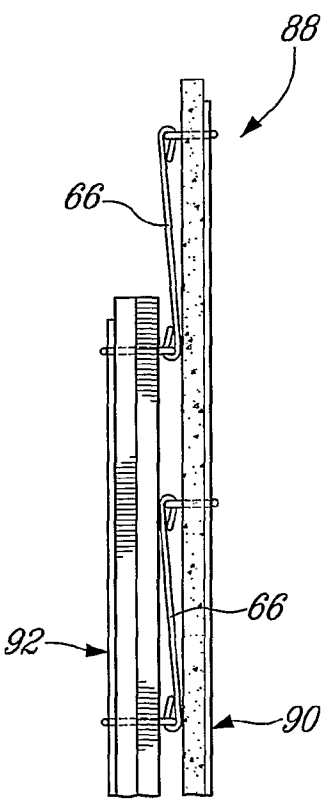
FIGS. 16A-16B are top plan partial views of the module from FIG. 14, illustrating the first and second side wall panel structures of the module respectively in a retracted parallel relationship and in a spaced apart parallel relationship.
Figure 16A:
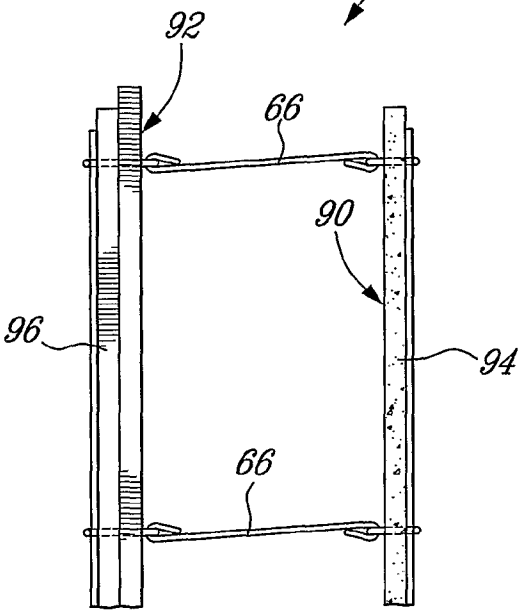

FIG. 16A illustrates the first and second side wall panel structures 90 and 92 fully extended in a spaced apart relationship. FIG. 16B illustrate the first and second side wall panel structures 90 and 92 in a retracted relationship.

Of course, the present invention allows many types and combination of board panels to be mounted to the grid 18.

A person skilled in the art will appreciate that the grids 18 of the side wall panel structures 90 and 92 of the module 88 can be further used as fixation boards whereby construction elements, such as brick's strip, crepidoma, stucco, bushing (all not shown), can be attached thereon since it is not embedded in the panels 94 and 96.

Of course, the concrete wall formwork corner element 42 can be adapted to complement the module 88. Such corner element (not shown) would include two panels mounted on an L-shaped grid.

Figure 18:
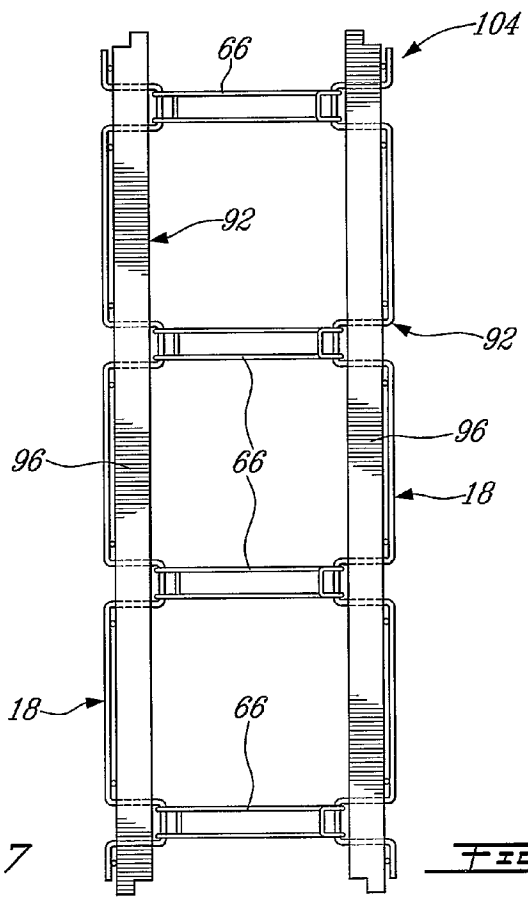
FIG. 18 is a side elevation of a concrete wall formwork module according to a fifth illustrative embodiment of the present invention.
Figure 17:
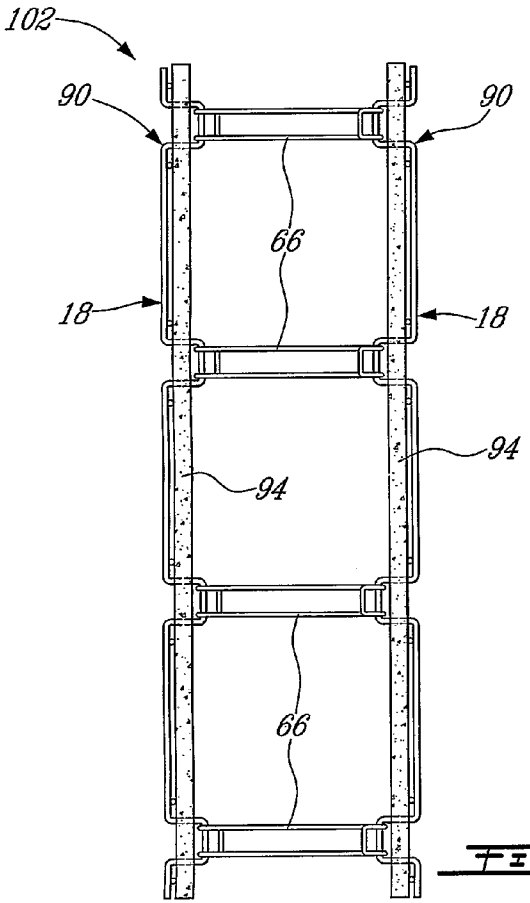
FIG. 17 is a side elevation of a concrete wall formwork module according to a fourth illustrative embodiment of the present invention.

FIGS. 17 and 18 show two concrete wall formwork modules 102 and 104 respectively according to fourth and fifth embodiments of the present invention.

Since both modules 102 and 104 are very similar to the module 88, only the differences between these respective modules and the module 88 will be described herein.

The concrete wall formwork module 102 comprises two side wall panel structures 90 and a plurality of connecting spacer rods 66 for hingedly interconnecting the two side wall panel structures 90.

Each side wall panel structures 90 and 92 includes a metallic wire grid 18 and a panel 94 so mounted thereon that the grid 18 is positioned on the exterior side surface of the panel 94.

The concrete wall formwork module 104 comprises two side wall panel structures 92 and a plurality of connecting spacer rods 66 for hingedly interconnecting the two side wall panel structures 92.

Each side wall panel structures 92 includes a metallic wire grid 18 and a panel 96 so mounted thereon that the grid 18 is positioned on the exterior side surface of the panel 96.

Figure 19:
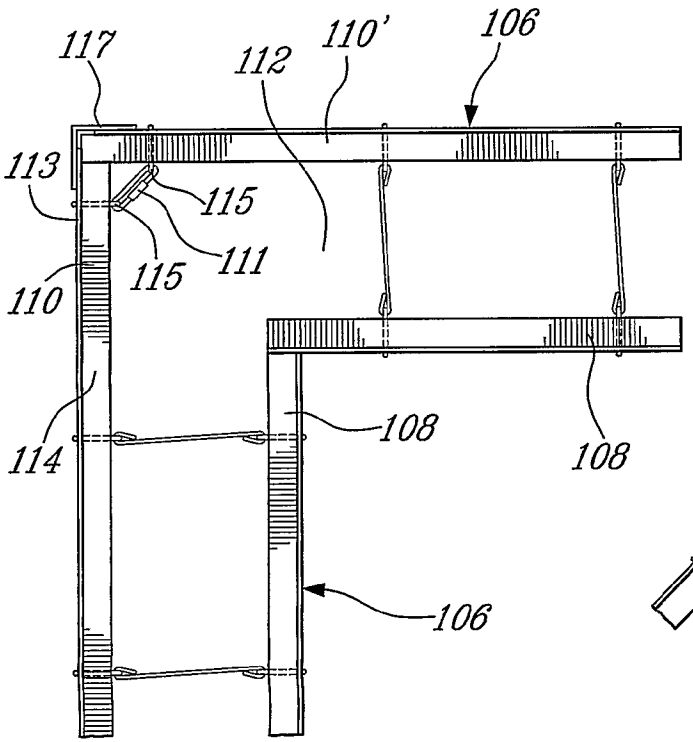
FIG. 19 is a top plan view illustrating a method for creating a 90 degrees corner between two intersecting modules similar to the module from FIG. 18.

In FIG. 19, two modules 106 are joined perpendicularly so as to form a 90 degrees corner assembly. The modules 106 are identical to the modules 104 with the exception that the side wall panel structure 108 is shorter than the side wall panel structure 110 or 110'. This allows perpendicularly abutting the two modules 106 and still yielding a continuous canal 112 for receiving concrete (not shown). Moreover, the horizontal rods 113 of the side wall panel structure 110 of the module 106 are made longer on one side so as to extend beyond the panel 114 for a distance sufficient to act both as support and as a longitudinal end stop for the side wall panel structure 110' of the module 106.

Connections between the two modules 106 and integrity of the resulting corner assembly are provided by 1) attaching the facing pair of stand-outs 115 located near the actual intersection of the two modules 106 using a clip 111, and 2) by securing an angle iron 117 at the intersection of the two modules 106 opposite the stand-outs 115 outside the channel 112.

Figure 20:
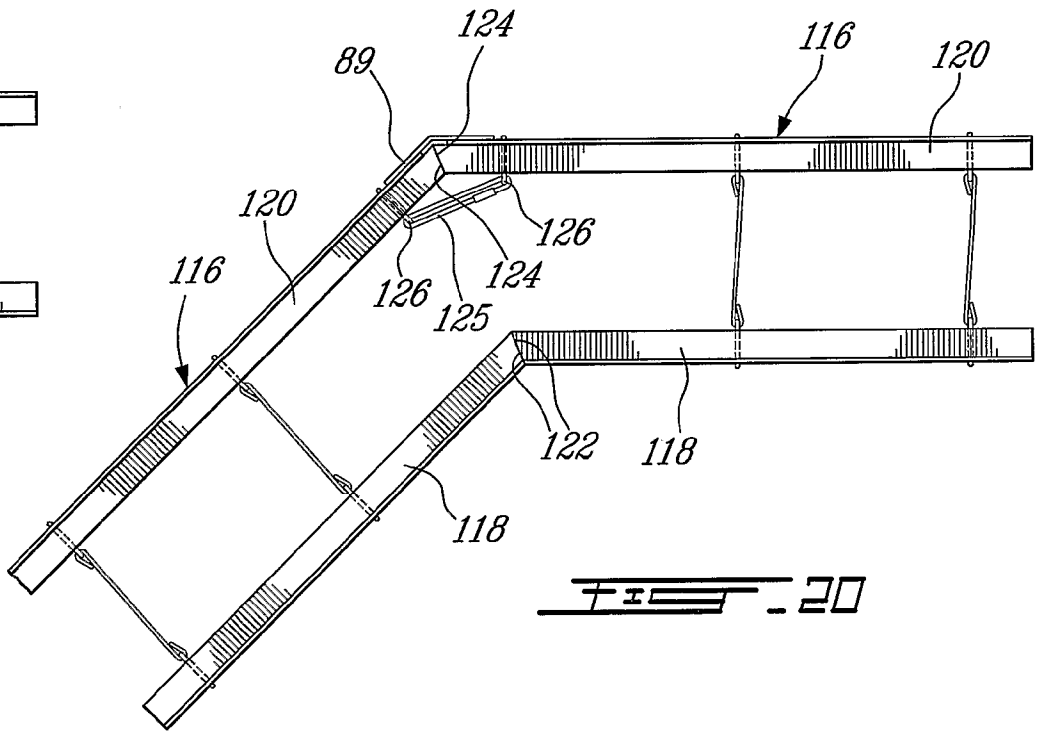
FIG. 20 is a top plan view illustrating a method for creating a 135 degrees corner between two intersecting modules similar to the module from FIG. 18.

FIG. 20 illustrates the assembly of two modules 116 into a 135 degrees corner. This assembly is achieved by providing modules 116 structurally similar to the modules 104 but having the following differences: 1) the side panel structure 118 is shorter than the side panel structure 120, and 2) the two longitudinal ends 122 and 124 of both side panel structures 118 and 120 defines a 67.5 degrees with the plane defines by the panels 118 and 120. Thereby, abutting the two longitudinal ends 122 and 124 of a first module 116 with the respective longitudinal ends 122 and 124 of another module 116 results in a 135 degrees corner. Of course, a corner having another angle can be provided by providing side panel structures having longitudinal ends defining half that angle.

As described with reference to FIG. 19, connections between the two modules 116 is provided 1) by attaching facing pairs of stand-outs 126 located near the actual intersection of the two modules 116 using a clip 125, and 2) by securing an elongated 135-degrees angled corner plate 89 at the intersection of the two modules 116 opposite the stand-outs outside the channel formed thereby.

The assembly of formwork 128 will now be further described with reference to FIG. 21.

The formwork 128 comprises a plurality of concrete wall formwork modules 10 assembled as described with reference to FIG. 5. The use of scaffolding 130, including erecting beams 132, allows to vertically leveling the formwork 128 in additions to serve as working platform for workers (not shown).

Aligning beams (not shown) can also be used for vertically aligning leveling the formwork.

Figure 21:
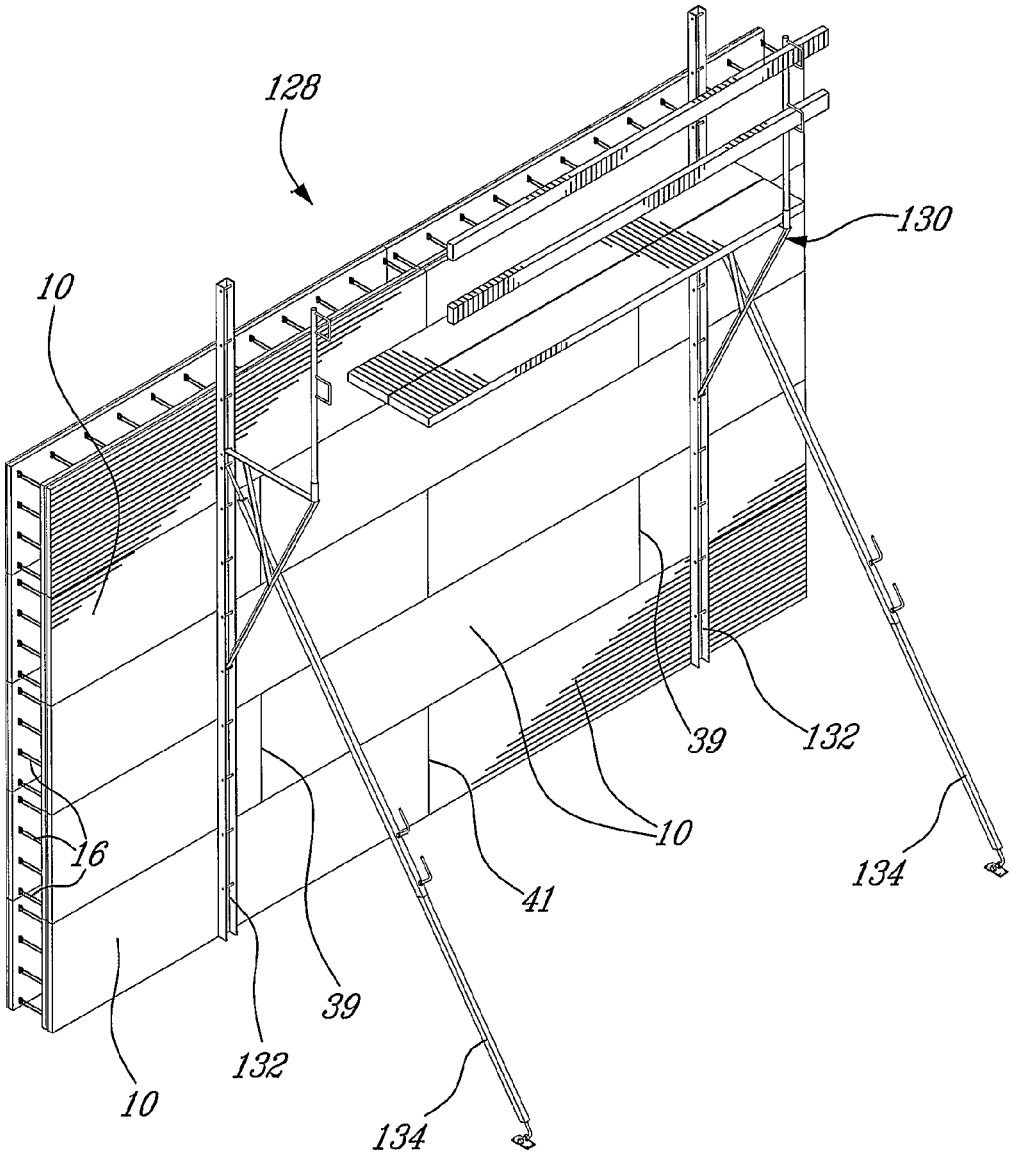
FIG. 21 is a perspective view illustrating the assembly of a formwork wall using modules from FIG. 1.

The erecting beams 132 are secured to the modules 10 via their respective fastening plate 40 (not shown in FIG. 21). In cases where the formwork is assembled from concrete wall formwork module from the present invention wherein the grid is not embedded into the panel, the erecting beams 132 can be secured directly to the grid.

The scaffolding 130 further includes telescopic poles 134 for aligning the wall 128. The poles 134 are further provided with fine adjustment means operable by rotation of the poles 134.

As mentioned hereinabove, the formwork 128 is erected similarly to a brick wall. For example, the modules 10 on the second row are so positioned that the lateral joints 39 between two adjacent modules are not aligned with similar lateral joints 41 between two adjacent modules 10 from the first row. The same principle of course applies for any two consecutive rows.

Even though the formwork 128 is illustrated comprised of modules 10, other concrete wall formwork modules according to the present invention can also be used.

According to the present invention, tie wires, clips tie-rods or any fasteners can be used for attaching pairs of stand-outs while securing two adjacent modules.

The panels of the side wall panel structures are not limited to the materials described hereinabove. They can also be made without limitations of counterveneer, plasterboard, particle board, and any insolating plastic material. Also, as it has been described herein, any combination is also possible.

It is to be noted that a concrete wall formwork module according to the present invention can be provided with grids having different geometries than the one described herein. For example, the profile of the lugs may differ. They can have, for example, a rounded profile. Also, they can be made of independent pieces secured to the grids.

The general configuration of the grid may also differ from the orthogonal configuration illustrated. Also, the grid is not limited to the wire type.

The grid can be made of any metal, or of any composite material.

Even though the side wall panel structures of the concrete wall formwork modules form the present invention have been described as being rectangular, they can have other configuration.

Also, the two side wall panel structures of a single module can have different geometries.

Even though the lateral side edges of the panels have been illustrated as being flat, they can be provided with tongues-and-grooves or with any other complementary cooperating means.

Although the present invention has been described hereinabove by way of illustrated embodiments thereof, it can be modified without departing from the spirit and nature of the subject invention, as defined in the appended claims.

What is claimed is:

1. A concrete wall formwork module comprising:

a first side wall panel structure including a first wire mesh and a first panel embedding a majority of the first wire mesh so as to prevent concrete from contacting the majority of the first wire mesh;

a second side wall panel structure including a second wire mesh and a second panel embedding a majority of the second wire mesh so as to prevent the concrete from contacting the majority of the second wire mesh; and at least two connecting rods having about a same length hingedly interconnecting said first and second side wall panel structures to allow movement thereof between a retracted parallel relationship to a spaced apart parallel relationship which results in a deployed concrete wall formwork module adapted to receive concrete poured therebetween and withstand sideways thrust occurring between said first and second side wall panel structures;

wherein each of the first and second panels is made of an insulated material; each of the first and second wire meshes including a first series of parallel wires extending respectively along said first and second panels; at least two of said parallel wires of each of the first and second wire meshes including stand-out portions extending out of the respective first and second panels for receiving said connecting rods;

wherein the length of each connecting rod is less than a distance between horizontally adjacent stand-out portions of the respective first and second panels.

2. The module as recited in claim 1, wherein at least one of said first and second wire meshes further includes a second series of parallel wires extending generally along said respective one of said first and second panels generally perpendicularly from said first series of parallel wires.

3. The module as recited in claim 2, wherein each wire from said second series of parallel wires is secured to said first series of parallel wires on a side of said first series of parallel wires facing said connecting rods.

4. The module as recited in claim 1, wherein at least one of said first and second wire meshes is a rectangular mesh.

5. The module as recited in claim 1, wherein each of said first and second wire meshes include at least two spaced apart lugs, each for receiving a respective one of said at least two connecting rods.

6. The module as recited in claim 1, wherein at least one of said first and second panels has top and bottom edge portions configured for complementary engagement.

7. The module as recited in claim 6, wherein one of said top and bottom edge portions has a first groove on the front side thereof; the other of said top and bottom edge portions having a second groove on the back side thereof.

8. The module as recited in claim 6, wherein said top and bottom edge portions are provided with tongue-and-groove complementary engagement means.

9. The module as recited in claim 1, wherein at least one of said first and second panels has first and second lateral side edge portions configured for complementary engagement.

10. The module as recited in claim 9, wherein one of said first and second lateral side edge portions has a first groove on the front side thereof; the other of said first and second lateral side edge portions having a second groove on the back side thereof.

11. The module as recited in claim 9, wherein said first and second lateral side edge portions are provided with tongue-and-groove complementary engagement means.

12. The module as recited in claim 1, wherein said insulated material is a low density plastic foam material.

13. The module as recited in claim 12, wherein said low density plastic foam material is selected from the group consisting of polyurethane, expanded polystyrene and extruded polystyrene.

14. The module as recited in claim 1, wherein at least one of said connecting rods is in the form of elongated metal plate having two bended longitudinal ends defining two hook portions for respectively coupling with said first and second wire meshes.

15. The module as recited in claim 1, wherein at least one of said at least two connecting rods is in the form rectangular wire frames having two longitudinal ends folded up towards each other for respective connection with said first and second wire meshes.

16. The module as recited in claim 1, wherein at least one of said first and second side wall panel structures includes a fastening plate secured to respective one of said first and second wire meshes.

17. A formwork comprising at least one module as recited in claim 1.

18. A formwork comprising at least two modules as recited in claim 1 abutted to one another; wherein said at least two abutted modules are attached via said respective stand-out portions.

19. The formwork as recited in claim 18, wherein said at least two abutted modules are attached via a tie wire or a clip.

20. The formwork as recited in claim 18, wherein said at least two modules are abutted side by side so as to define an angle therebetween.

21. A method for creating a corner assembly for a formwork comprising:

providing a corner element having:

a reinforcing mesh defining two grid walls defining an angle therebetween; each grid wall having a side edge and a fastening plate secured to said side edge; and two panel elements, each one embedding a respective one of the grid walls;

providing first and second modules, wherein each of said first and second modules comprises:

a first side wall panel structure including a first wire mesh and a first panel embedding a majority of the first wire mesh so as to prevent concrete from contacting majority of the the first wire mesh;

a second side wall panel structure including a second wire mesh and a second panel embedding a majority of the second wire mesh so as to prevent the concrete from contacting the majority of the second wire mesh; and at least two connecting rods having about a same length hingedly interconnecting said first and second side wall panel structures to allow movement thereof between a retracted parallel relationship to a spaced apart parallel relationship which results in a deployed concrete wall formwork module adapted to receive concrete poured therebetween and withstand sideways thrust occurring between said first and second side wall panel structures;

wherein each of the first and second panels is made of an insulated material; each of the first and second wire meshes including a first series of parallel wires extending respectively along said first and second panels; at least two of said parallel wires of each of the first and second wire meshes including stand-out portions extending out of the respective first and second panels for receiving said connecting rods;

wherein the length of each connecting rod is less than a distance between horizontally adjacent stand-out portions of the respective first and second panels;

positioning each said first and second modules in said spaced apart relationship;

abutting both said first and second modules to said corner element so that said first side wall panels of both said first and second modules are positioned adjacent one another, said second wall panel of said first module contacts a first one of said fastening plates of said corner element and said second wall panel of said second module contacts a second one of said fastening plates of said corner element;

fastening said second wall panel of said first module to said first one of said fastening plates of said corner element and said second wall panel of said second module to said second one of said fastening plates of said corner element;

securing said first wall panel of said first module to said first wall panel of said second module using an iron angle; and securing said iron angle to said corner element.

22. The method as recited in claim 21, including securing said iron angle to said corner element via corner rods.

23. The method as recited in claim 22, including attaching said corner rods to said corner element via said reinforcing mesh.

* * * * *